United States Patent [19]

Ikeda

[11] 4,444,027

[45] Apr. 24, 1984

[54] WASHING APPARATUS

[75] Inventor: Yoshio Ikeda, Aichi, Japan

[73] Assignee: Tokyo Shibaura Denki Kabushiki Kaisha, Kanagawa, Japan

[21] Appl. No.: 313,352

[22] Filed: Oct. 20, 1981

[30] Foreign Application Priority Data

Oct. 31, 1980 [JP] Japan ..... 55-154220

[51] Int. Cl.[3] ..... D06F 17/08; D06F 23/04

[52] U.S. Cl. ..... 68/23.6; 68/133; 74/413

[58] Field of Search ..... 68/23.6, 89, 133, 136; 366/314, 317; 74/431, 413

[56] References Cited

U.S. PATENT DOCUMENTS

| | | | |
|---|---|---|---|
| 1,929,196 | 10/1933 | Waddell | 74/413 |
| 2,021,097 | 11/1935 | Maus | 68/133 |
| 2,071,622 | 2/1937 | Gibson . | |
| 2,660,045 | 11/1953 | Bretter | 68/133 X |
| 2,753,731 | 7/1956 | McWethy | 74/413 X |
| 2,973,637 | 3/1961 | Sisson . | |
| 3,095,721 | 7/1963 | Bochan | 68/133 |
| 3,772,902 | 11/1973 | Noguchi | 68/23.6 X |
| 4,128,018 | 12/1978 | Muntean | 74/413 |
| 4,202,187 | 5/1980 | Hukuzawa et al. . | |

FOREIGN PATENT DOCUMENTS

| | | | |
|---|---|---|---|
| 229806 | 8/1960 | Australia . | |
| 1159679 | 2/1958 | France | 68/23.6 |
| 52-54272 | 5/1977 | Japan | 68/23.6 |
| 53-126772 | 11/1978 | Japan | 68/133 |
| 54-149270 | 11/1979 | Japan . | |

*Primary Examiner*—Philip R. Coe

*Attorney, Agent, or Firm*—Schwartz, Jeffery, Schwaab, Mack, Blumenthal & Koch

[57] ABSTRACT

A washing apparatus having a tub for holding and draining a liquid, a spinnable tub for receiving materials to be washed and spin-drying the materials, a generally disk-shaped driven rotary base rotatably disposed in the spinnable tub on the bottom thereof at an eccentric position with respect to the axis of rotation of the spinnable tub, a support rotatably supporting the driven rotary base, a drive for selectively rotating the spinnable tub on the rotary base, and a pulsator detachably mounted on the rotary base for generating an eccentric liquid whirlpool in the tub.

21 Claims, 8 Drawing Figures

WASHING APPARATUS

BACKGROUND OF THE INVENTION

The present invention relates to a washing apparatus and more particularly to an improvement of a washing apparatus having a pulsator disposed eccentrically in a spinnable tub on the bottom thereof.

In a conventional washing apparatus of the type having a pulsator disposed at an eccentric position to the center axis of the spinnable tub for an increased washing power, the pulsator is fixed to the upper portion of a pulsator shaft disposed at an eccentric position to the center axis of the spinnable tub. Since the pulsator shaft has a driven gear positioned outside of the bottom of the spinnable tub, it is impossible to leave out or remove pulsator shaft.

Furthermore, in another conventional washing apparatus, the pulsator disposed at an eccentric position has teeth formed thereon which are held in mesh with a gear mechanism inside of the bottom of the spinnable tub for the transmission of rotation from a drive shaft to the pulsator, the pulsator and teeth being integrally molded together. Since the teeth are required to be resistant to wear, the pulsator, of which the gear is an integral part, must be molded of a wear-resistant plastic material which is expensive. Using a costly material for the entire pulsator which does not need to be made of the expensive material is uneconomical and leads to an increased overall cost of manufacture.

SUMMARY OF THE INVENTION

Therefore, it is an object of the present invention to provide a novel and improved washing apparatus including a pulsator.

Another object of the invention is to provide such a washing apparatus in which the pulsator is detachable from a generally disk-shaped driven rotary base disposed at an eccentric position in a spinnable tub on the bottom thereof, thereby allowing an increase in the washing power while achieving a simplification of assembly by mounting the pulsator on the driven rotary base after arranging the driven rotary base on the bottom of the spinnable tub.

It is another object of the invention to provide a novel washing apparatus in which the driven rotary base is made of a wear-resistant material and the pulsator detachably mounted on the driven rotary base is made of a resilient material.

It is still another object of the invention to provide a novel washing apparatus in which the driven rotary base is constructed so that a transmission means to be engaged with the rotary base can be observed through the driven rotary base for assembly or inspection.

In accomplishing the foregoing objects, there has been provided according to the invention a washing apparatus comprising an outer tub for holding and draining a liquid, a spinnable tub arranged inside of the outer tub for receiving materials to be washed and extracting the liquid from the materials, a generally disk-shaped driven rotary base disposed in the spinnable tub on the bottom at an eccentric position with respect to the axis of rotation of the spinnable tub, support means for rotatably supporting the driven rotary base, drive means for selectively rotating the spinnable tub or the driven rotary base, and a pulsator detachably mounted on the driven rotary base.

Other objects, features and attendant advantages of the invention will become readily apparent as the apparatus becomes better understood by reference to the following detailed description of preferred embodiments, when considered in connection with the accompanying drawings.

BRIEF DESCRIPTION OF THE DRAWINGS

In the drawings, forming a part hereof, in which like reference characters denote like parts in the various views.

DETAILED DESCRIPTION OF PREFERRED EMBODIMENTS

Figure 1:
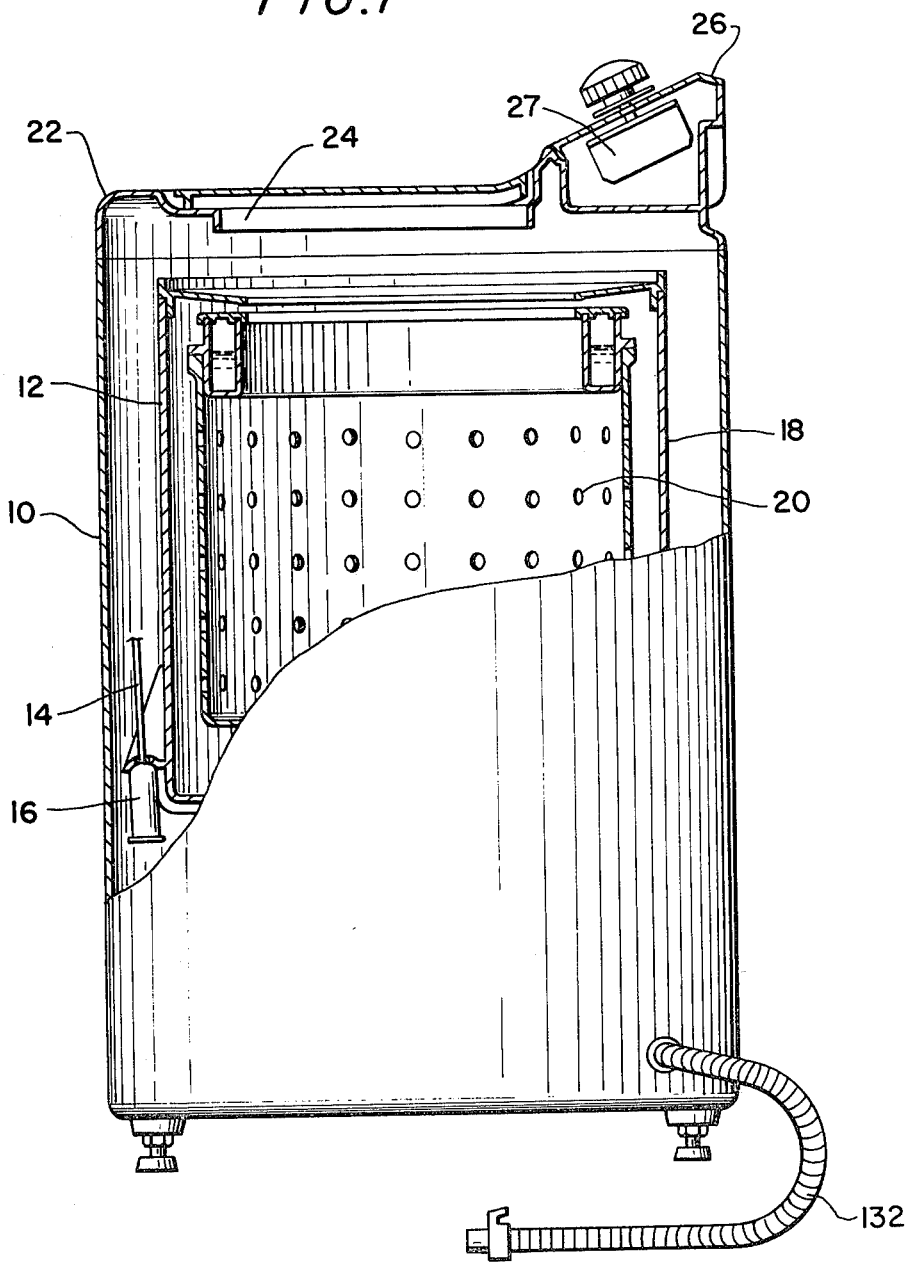
FIG. 1 is a side view, partially in section of a washing apparatus according to the first embodiment of the iinvention.

Now there will be described a first embodiment of the invention according to FIGS. 1 through 3. In FIG. 1, which shows the overall structure in general, an outer cabinet 10 resiliently supports therein a tub 12 through the hanger rod 14 of a resilient supporting mechanism 16. A spinnable tub 18 made, for example, of plastic is arranged in the tub 12 and has in its peripheral wall a multiplicity of holes 20. A cover frame 22 is mounted over the generally open top of the cabinet 10 and has a substantially central opening 24 through which materials to be washed can be placed into and taken out of the spinnable tub 18. The cover frame 22 has a rear control box 26 projecting upwardly and having a timer switch 27 attached thereto.

Figure 2:
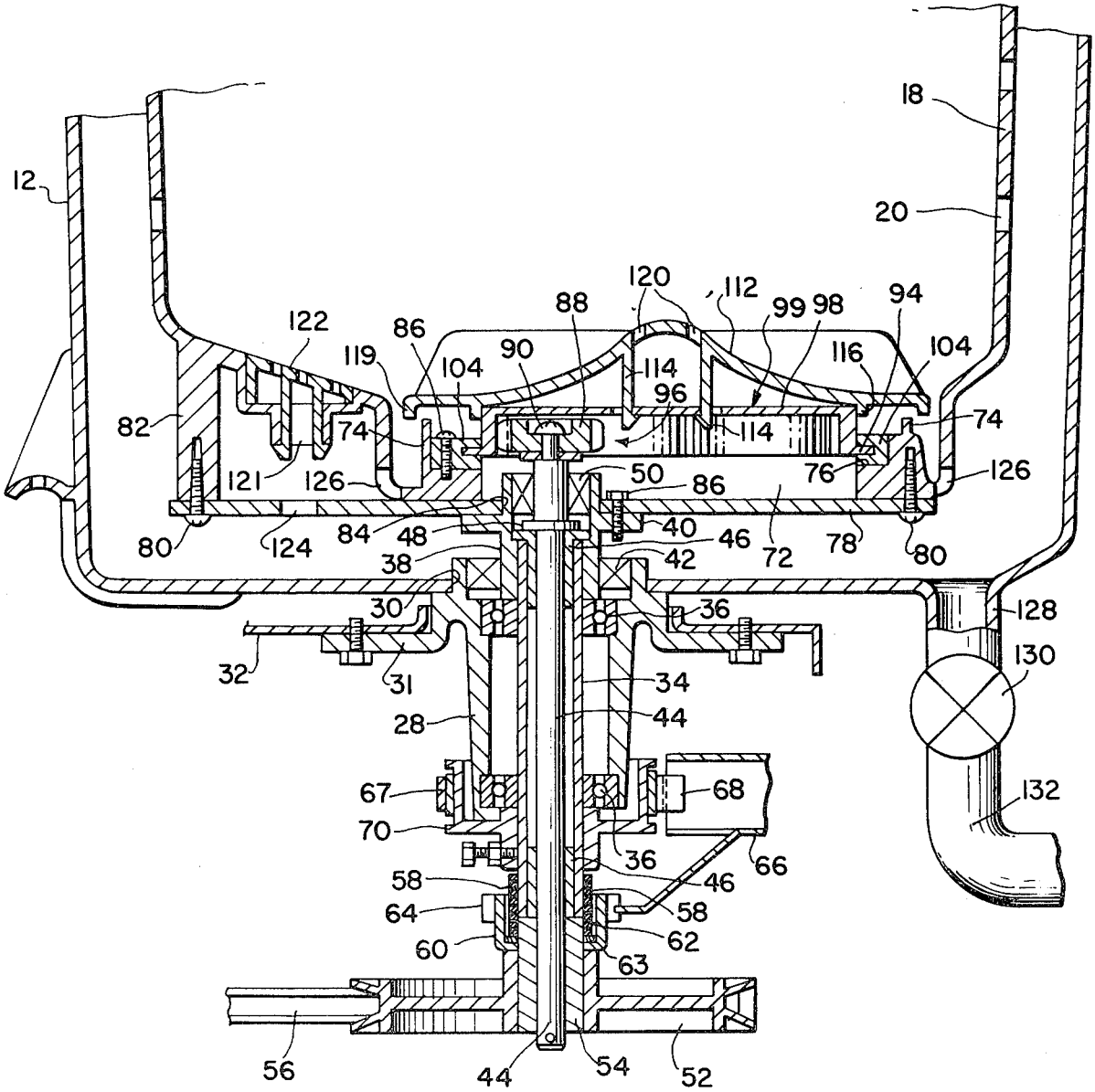
FIG. 2 is an enlarged fragmentary vertical cross-sectional view of the washing apparatus according to the first embodiment of the invention.

FIG. 2 illustrates the main mechanism of the first embodiment of the invention. A housing 28 is secured, for example, by screws to the bottom of the tub 12, with the upper end of the housing 28 fitted in a central aperture 30 in the bottom of the tub 12. The housing 28 has a peripheral flange 31 to which there is attached a support plate 32 for mounting thereon a driving motor (not shown). A hollow shaft 34 extends through and is supported by a pair of upper and lower bearings 36, 36 in the housing 28. The hollow shaft 34 is filled at its upper end into a connector sleeve 38 having a flange 40 at a substantially intermediate portion thereof. The connector sleeve 38 has its lower end disposed in the upper end of the housing 28 and is surrounded peripherally by a sealing member 42 for the housing 28 in frictional contact therewith. A solid shaft 44 extends coaxially through the hollow shaft 34, with a pair of upper and lower bearings 46, 46 interposed therebetween, and the shaft 44 has adjacent to its upper end a flange 48 held against the upper bearing 46 at the upper end of the hollow shaft 34. The shaft 44 has its upper end projecting upwardly through a sealing member 50 inserted in the connector sleeve 38 at its upper end. A pulley 52 has its sleeve shaft 54 fitted over the lower end portion of the shaft 44, the pulley 52 being coupled to the motor through a belt 56. A clutch spring 58 is coiled around the lower end portion of the hollow shaft 34 and the sleeve shaft 54. A clutch sleeve 60 is loosely disposed around the clutch spring 58 and has in its inner periphery a groove 62 receiving therein the lower end 63 of the clutch spring 58. The clutch sleeve 60 has a multiplicity of teeth 64 around its outer periphery. A control lever 66 is actuatable by an electromagnetic device (not shown) into and out of engagement with the teeth 64 to tighten and loosen the clutch spring 58 for connecting the hollow shaft 34 to and disconnecting the hollow shaft 34 from the sleeve shaft 54. A brake drum 67 is fitted around the lower end portion of the hollow shaft 34. An annular brake band 68 with ends, one of them having a tongue 70, is wound around the outer periphery of the brake drum 67, the brake band 68 being controllable by the control lever 66. When the control lever 66 abuts against the tongue 70 of the brake band 68, the brake band 68 is prevented from rotating with the brake drum 67 to brake the latter.

The spinnable tub 18 has in its bottom an off-center circular recess 72 displaced a certain interval eccentrically with respect to the center axis of the bottom of the spinnable tub 18. A substantially annular dike wall 74 is disposed on the bottom of the spinnable tub 18 and extends along the outer edge of the bottom for preventing entry of materials to be washed or foreign matter. An annular shield step portion 76 extends inwardly of the dike wall 74 in integral relation therewith, the bottom portion inward of the step portion 76 being open and closed by a bottom plate 78. The bottom plate 78 is fixed by screws 80 to an attachment base 82 and an opposite lower end of the step portion 76 of the spinnable tub 18. The bottom plate 78 has a through opening 84 located concentrically with the center of the spinnable tub 18 for receiving the connector sleeve 38 on the hollow shaft 34. The bottom plate 78 and the connector sleeve 38 are fastened together by bolts 86 (only one shown) to connect the spinnable tub 18 directly to the hollow shaft 34.

A drive gear 88 is fitted over the upper end portion of the shaft 44 which projects into the recess 72, the drive gear 88 being fixed by a screw 90 to the solid shaft 44. A generally disk-shaped driven rotary base or a driven gear 92 (shown in FIG. 3) in the form of an internal gear is made of a wear-resistant plastic material, such as polyacetal, and has a flange 94 around its lower peripheral end. The drive gear 88 as a transmission means to the driven gear 92 together with the driven gear 92 jointly constitute a gear mechanism 96. The driven gear 92 and the drive gear 88 are positioned in the recess 72, with the result that the driven gear 92 is eccentric to the spin axis of the spinnable tub 18.

Figure 3:
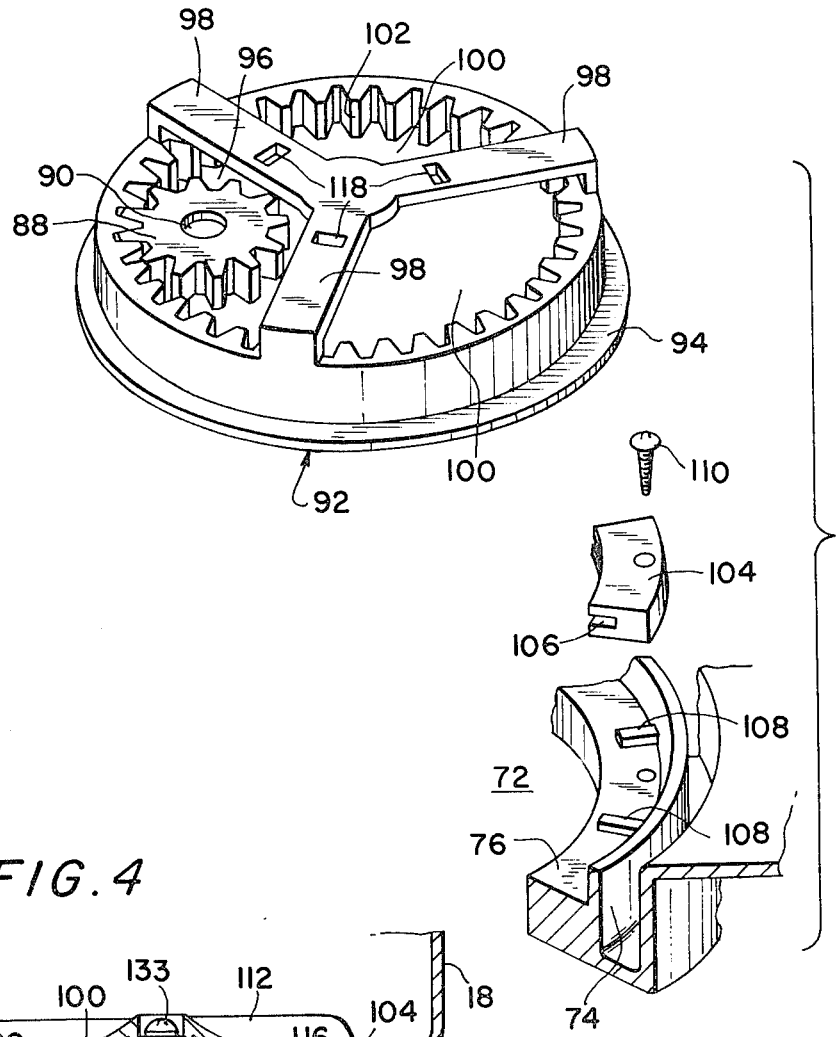
FIG. 3 is an enlarged exploded perspective view showing a driven rotary base and support means according to the first embodiment of the invention.

The driven gear 92 includes at its upper end a plurality of, three for example, spoke arms 98 extending radially and being circumferentially spaced at equal angular intervals to provide openings 100 between adjacent spoke arms 98, through which internal teeth 102 of the driven gear 92 can be seen as shown in FIG. 3. A plurality of sliding bearings 104 serve as support means for the driven gear 92 and are made, for example, of polyacetal, each having a generally U-shaped cross-section. The sliding bearings 104 are mounted on the step portion 76 at spaced intervals and have slots 106 in which are inserted the flange 94 of the driven gear 92. The driven gear 92 is thus confined vertically at its flange 94 and is supported at spaced locations along its outer peripheral edge for rotation. A plurality of pairs of ridges 108 project on the step portion 76, each pair receiving one of the sliding bearings 104, 104 fitted therebetween so as to hold it in position. Some of the sliding bearings 104 are fixed by screws 110 to the step portion 76 to prevent the driven gear 92 from being dislodged out of place.

Thus, with the generally disk-shaped driven rotating base or the driven gear 92 supported around its periphery, no expensive shaft is necessary, which has conventionally been made of stainless steel for its corrosion resistivity, resulting in a reduced cost of manufacture.

Furthermore, with the disk wall 74 extending around the driven gear 92, foreign matter such as sand is prevented from getting into the gear mechanism past the outer periphery of the driven gear 92. Therefore, the drive gear 88 and the driven gear 92 are prevented from being subjected to undue wear and from being locked by foreign matter trapped therebetween.

Further, with the sliding bearing 104 located at spaced intervals along the circumference of the driven gear 92, even though foreign matter such as sand enters into the sliding bearings 104 over the shield wall 74, it will pass by the surfaces of the sliding bearings 104, and the cost of material of such sliding bearings is less than that of material of a sliding bearing which extends the full circumference. In addition, with the driven gear 92 comprising an internal gear and having openings 100 in its upper portion to allow visual observation of the internal teeth 102 therethrough, the driven gear 92 can be attached while confirming how the drive and driven gears mesh with each other. This arrangement is quite advantageous when the two gear parts are being assembled or inspected.

A pulsator 112, which is made of a relatively inexpensive material different from that of the driven gear 92, such as polypropylene, includes a plurality of, three for example, resilient locking prongs 114 projecting downwardly at certain positions corresponding to the spoke arms 98. The pulsator 112 has an annular rib 116 directed downwardly near the outer periphery thereof which fits around the outer periphery of the driven gear 92. The resilient locking prongs 114 are held in engagement in three engagement holes 118, respectively, in the spoke arms 98 of the driven gear 92. Thus, the resilient locking prongs 114 and engagement holes 118 jointly constitute a resilient engagement mechanism which allows detachable mounting of the pulsator 112 on the driven gear 92. The pulsator 112 has an outer annular rib 119 directed downwardly between the outer edge of the recess 72 and the dike wall 74.

With the pulsator 112 being detachably mountable on the driven gear 92 by the resilient engagement mechanism, including the resilient locking prongs 114 and engagement holes 118, the pulsator 112 can be assembled in position more easily than it could be assembled by screws. Furthermore, materials are prevented from getting caught and damaged while being washed, which would otherwise happen with such screws present. A molded hole 120 adjacent to each locking prong 114 is used for pushing away the locking prong 114 by a screwdriver, for example, upon disengaging the pulsator 112 and the driven gear 92.

The bottom of the spinnable tub 18 has a hole 121 in which a strainer 122 is disposed. The bottom plate 78 has holes 124, and the bottom of the recess 72 has a drain hole 126 located outside the dike wall 74. The tube 12 has at its bottom an integral drain tube 128 which is connected via a drain valve 130 to a drain hose 132 for discharging water out of the tub 12 and the spinnable tub 18.

The operation of this embodiment of the invention will now be described as follows:

With materials to be washed and a detergent put into the spinnable tub 18, the timer switch 27 is set, whereupon a water supply valve (not shown) is opened to supply liquid or water into the spinnable tub 18. When water reaches a predetermined level, a water level sensing switch (not illustrated) is actuated to close the water supply valve and at at the same time the energize the motor. At this time, the electromagnetic device remains energized to brake the brake band 68 with the control lever 66 and disconnect the clutch spring 58, allowing rotation to be transmitted from the motor through the belt 56 only to the shaft 44. Rotation of the shaft 44 is transmitted to the pulsator 112 via the gear mechanism 96 which comprises the drive gear 88 and driven gear 92, whereupon the pulsator 112 is caused to rotate to wash the material with the detergent. The center of the whirlpool of water by the pulsator 112 is eccentric to the center of the spinnable tub 18, resulting in an increased washing power. When washing with the detergent is completed, the washwater is discharged from the tub 12 and the spinnable tub 18, through the drain hose 132, and the next step then follows. In the dewatering or spin-drying step, the electromagnetic device is de-energized to release the brake band 68 and connect the clutch spring 58. At the same time, the motor is energized to enable the spinnable tub 18 to be spun at a high speed through the hollow shaft 34, causing water containing detergent to be extracted from the materials being washed by means of centrifugal forces. Then, the spinnable tube 18 is supplied with water and the pulsator 112 is driven to rinse out the materials. Such rinsing, draining and spinning steps are repeated several times in sequence before the full washing process is completed.

With the structure according to this embodiment, the driven rotary base or a driven gear 92 and the pulsator 112 are separate members, and the pulsator 112 is detachably mounted on the driven gear 92. The driven gear 92 may be made of a wear-resistant, but expensive material such as, for example, a polyacetal, and the pulsator 112 may be made of an inexpensive resin, such as, for example, a polypropylene, to reduce the overall cost of manufacture. This arrangement is different from prior constructions in which driven gears and pulsators are integrally formed. The integral driven gear and pulsator have proved to be disadvantageous in that, when the driven gear is formed to have an increased thickness to provide mechanical strength, the pulsator tends to create a recess in its surface due to so-calleed "shrinkage" on molding, resulting in an unsightly appearance and poorer washing performance. According to this embodiment of the present invention, however, the driven gear 92 can have an increased thickness regardless of the pulsator 112, and no change in thickness of the pulsator 112 results which would bring about shrinkage. Although the pulsator 112 and the driven gear 92 are separate, the driven gear 92 is rotatably supported directly on the bottom of the spinnable tub 18, and the degree of eccentricity of the driven gear 92 can be held as small as possible in comparison with an arrangement in which a pulsator with a driven gear would be rotatably supported by a shaft. Thus, the drive gear 88 and the driven gear 92 are held neatly in mesh with each other for effective transmission of rotation.

Figure 4:
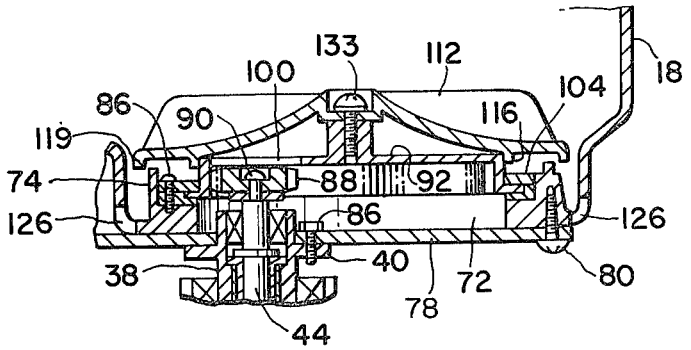
FIG. 4 is a fragmentary vertical cross-sectional view of the second embodiment of the invention.

While in the foregoing embodiment the pulsator 112 is attached to the driven gear 92 by the resilient locking prongs 114, the pulsator 112 may alternatively be secured to the driven gear 92 by a screw 133, as shown in FIG. 4.

Figure 5:
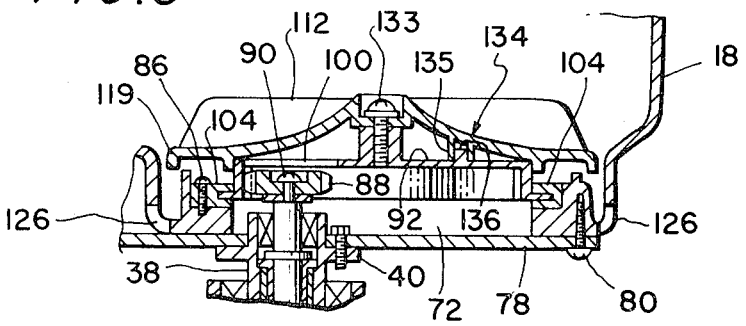
FIG. 5 is a view similar to FIG. 4, showing an interfitting mechanism.

As illustrated in FIG. 5, the pulsator 112 and the generally disk-shaped driven rotary base or the driven gear 92 may be prevented from relative rotation by an interfitting mechanism 134, which includes a recess 135 on the pulsator 112 and a projection 136 on the driven gear 92 fitted into the recess 135. With this construction, rotational power can be transmitted more reliably from the driven gear 92 to the pulsator 112.

Figure 6:
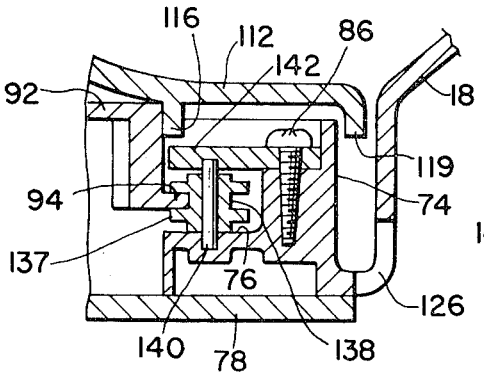
FIGS. 6 and 7 are enlarged fragmentary vertical cross-sectional views, showing supporting means of other embodiments according to the invention.
Figure 7:
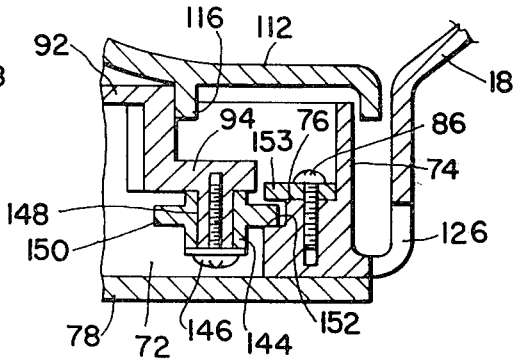

According to the embodiments shown in FIGS. 6 and 7, each generally disk-shaped driven rotary base or driven gear 92 is supported for its rotation by a plurality of rollers. More specifically, in FIG. 6, a roller 137 has a groove 138 extending fully in and around its periphery. A rotative shaft 140 has its upper and lower ends journalled into the step portion 76 in the recess 72 and an annular holder plate 142. A plurality of such rollers 137 are spaced at intervals along the step portion 76. The flange 94 of the driven gear 92 is inserted and supported in the grooves 138 for rotation.

In FIG. 7, a plurality of rollers 144 are rotatably mounted by screws 146 around studs 148 projecting from the underside of the flange 94 of the driven gear 92 and located at spaced intervals therearound. The rollers 144 have portions 150 extending radially outwardly of the driven gear 92 for resting upon an annular bearing shoulder 152 on the step portion 76 in the recess 72. The roller portions 150 are retained against displacement by an annular holder plate 153 disposed above them.

With the structures of these embodiments, the pulsator 112, while in rotation, is subjected to a resistance which is composed of a relatively small amount of rolling friction between the driven gear 92 and the roller 137 or 144.

Figure 8:
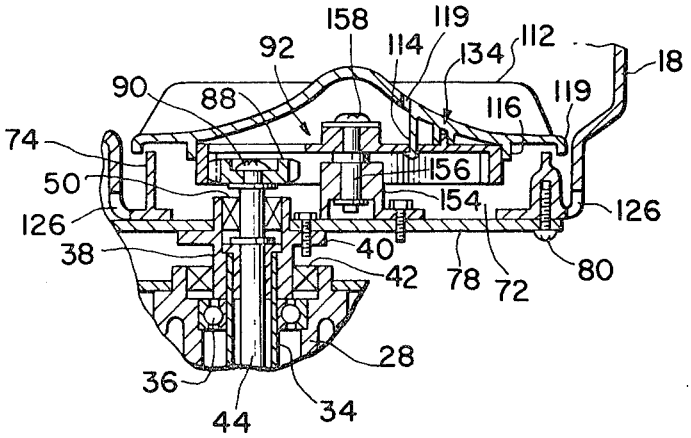
FIG. 8 is a vertical cross-sectional view showing still another embodiment of the invention.

While in all of the above-mentioned embodiments the driven gear 92 is shown as being supported at its outer periphery, the invention should not be interpreted as being limited to such an arrangement. As another embodiment, FIG. 8 shows a bearing sleeve 154 disposed off-center at a position spaced a given interval from the shaft 44 and rotatably supporting a shaft 156 over which the generally driven rotary base or the driven gear 92 is rotatably fitted. The driven gear 92 is fixed to the shaft 156 by a screw 158. Thus, the driven gear 92 is rotatably supported at its center axis on the bottom of the spinnable tub 18. The pulsator 112 is detachably mounted on the driven gear 92.

The illustrated embodiments should not be considered to be restrictive, but various changes may be made without departing from the scope of the invention.

What is claimed is:

1. A washing apparatus, comprising:

an outer tub for holding and draining a liquid;

a spinnable tub arranged inside of said outer tub for receiving materials to be washed and extracting the liquid from the materials;

a generally disk-shaped driven rotary base disposed in said spinnable tub on the bottom at an eccentric position with respect to the axis of rotation of said spinnable tub;

support means for rotatably supporting said driven rotary base;

drive means for selectively rotating said spinnable tub or said driven rotary base; and a pulsator detachably mounted on said driven rotary base.

2. A washing apparatus according to claim 1, wherein said support means comprises means for rotatably supporting the outer periheral edge portion of said driven rotary base.

3. A washing apparatus according to claim 2, wherein said driven rotary base further comprises a flange around the outer peripheral edge portion to be supported by said support means.

4. A washing apparatus according to claim 2, wherein said support means further comprises a plurality of sliding bearings to support said outer peripheral edge of the driven rotary base at spaced locations therealong.

5. A washing apparatus according to claim 4, wherein said sliding bearings comprise a substantially U-shaped cross-section engaging said outer peripheral edge of the driven rotary base between the two legs to secure said base against vertical displacement.

6. A washing apparatus according to claim 2, wherein said support means further comprises a plurality of rollers.

7. A washing apparatus according to claim 2, wherein said driven rotary base further comprises a plurality of rollers provided on the outer peripheral edge at spaced locations therealong and said support means further comprises an annular bearing shoulder supporting the rollers.

8. A washing apparatus according to claim 1, wherein said spinnable tub includes a recess in its bottom for containing said driven rotary base and said support means.

9. A washing apparatus according to claim 8, wherein said recess further includes a dike wall extending along the outer edge of the recess for preventing entry of foreign matter.

10. A washing apparatus according to claim 9, wherein said recess further includes a drain hole located outside of said dike wall.

11. A washing apparatus according to claim 9, wherein said pulsator further comprises an outer annular rib directed downwardly between said dike wall and said outer edge of the recess.

12. A washing apparatus according to claim 1, wherein said drive means further comprises a hollow shaft connected to the center of the bottom of said spinnable tub for rotatably mounting the spinnable tub in said outer tub, a second shaft rotatably penetrating said hollow shaft and extending at the upper end thereof into the inner bottom of said spinnable tub, a transmission for transmitting the rotation of said second shaft to said driven rotary base, and a selectively engageable clutch arranged between said hollow shaft and said second shaft.

13. A washing apparatus according to claim 12, wherein said transmission further comprises a first gear provided at the upper end portion of said second shaft and said rotary base further comprises a driven gear to engage with said first gear.

14. A washing apparatus according to claim 13, wherein said driven gear is comprised of a wear-resistant material and said pulsator detachably mounted on said driven gear is comprised of a resilient material.

15. A washing apparatus according to claim 13, wherein said driven gear comprises internal teeth.

16. A washing apparatus according to claim 15, wherein said driven gear further comprises an opening to allow visual observation therethrough of said internal teeth.

17. A washing apparatus according to claim 16, wherein said driven gear further comprises a plurality of spoke arms crossing said opening.

18. A washing apparatus according to claim 17, wherein said pulsator is comprised of a resilient material and includes at least one locking prong on the underside, and said spoke arms include at least one recess for engaging with each prong.

19. A washing apparatus according to claim 1, wherein said pulsator further comprises a rib on the under side to fit about the outer periphery of said driven rotary base.

20. A washing apparatus according to claim 19, wherein said pulsator and said driven rotary base include an interfitting mechanism including a recess and a projection adapted to fit each other.

21. A washing apparatus according to claim 1, wherein said pulsator is comprised of a resilient material and includes at least one locking prong on the under side, and said driven rotary base includes a recess for engaging with each locking prong.

* * * * *